US010781042B2

(12) United States Patent
Wrigley et al.

(10) Patent No.: US 10,781,042 B2
(45) Date of Patent: Sep. 22, 2020

(54) EJECTION BLADE FOR A COMPACTION CHAMBER OF A WASTE COLLECTION VEHICLE

(71) Applicant: SUPERIOR PAK HOLDINGS PTY LTD, Queensland (AU)

(72) Inventors: Robert Wrigley, Queensland (AU); Michael Pronger, Queensland (AU)

(73) Assignee: Superior Pak Holdings Pty Ltd, Queensland (AU)

( * ) Notice: Subject to any disclaimer, the term of this patent is extended or adjusted under 35 U.S.C. 154(b) by 7 days.

(21) Appl. No.: 16/316,381

(22) PCT Filed: Jul. 10, 2017

(86) PCT No.: PCT/AU2017/050708
§ 371 (c)(1),
(2) Date: Jan. 9, 2019

(87) PCT Pub. No.: WO2018/009965
PCT Pub. Date: Jan. 18, 2018

(65) Prior Publication Data

US 2019/0233207 A1 Aug. 1, 2019

(30) Foreign Application Priority Data

Jul. 14, 2016 (AU) ..... 2016902771

(51) Int. Cl.
*B65F 3/28* (2006.01)
*B65F 3/20* (2006.01)
*B65F 3/02* (2006.01)

(52) U.S. Cl.
CPC ..... *B65F 3/28* (2013.01); *B65F 3/201* (2013.01); *B65F 2003/0283* (2013.01)

(58) Field of Classification Search
CPC ..... B65F 3/28; B65F 3/201; B65F 2003/0283
See application file for complete search history.

(56) References Cited

U.S. PATENT DOCUMENTS 3,273,728 A 9/1966 Kelso
4,221,527 A * 9/1980 Morrison ..... B65F 3/201 414/517

(Continued)

FOREIGN PATENT DOCUMENTS

AU 697334 10/1998
EP 2740631 6/2014

OTHER PUBLICATIONS

International Search Report and Written Opinion for International Application No. PCT/AU2017/050708 dated Sep. 5, 2017.

(Continued)

*Primary Examiner* — Kaitlin S Joerger
(74) *Attorney, Agent, or Firm* — Wegman Hessler

(57) ABSTRACT

An ejection blade for a compaction chamber with a hopper, the ejection blade including a blade body movable between a first position and a second position within the compaction chamber, and a lip attached to a lower portion of the blade body, the lip is movable to a raised position with respect to a floor of the compaction chamber when the blade body is moving to the first position and is in a lowered position with respect to the floor of the compaction chamber when the blade body is moving to the second position, wherein the first position is proximal to the hopper and the second position is distal to the hopper.

20 Claims, 4 Drawing Sheets

(56) References Cited

U.S. PATENT DOCUMENTS

| | | | | | |
|---|---|---|---|---|---|
| RE33,730 | E | * | 10/1991 | Smith | B65F 3/207 100/233 |
| 5,067,868 | A | * | 11/1991 | Boda | B65F 3/28 100/233 |
| 6,155,776 | A | | 12/2000 | Moyna | |
| 9,156,611 | B1 | * | 10/2015 | Campbell | B65F 3/041 |

OTHER PUBLICATIONS

Written Opinion for International Application No. PCT/AU2017/050708 dated Jun. 20, 2018.
International Preliminary Report on Patentability for International Patent Application No. PCT/AU2017/050708 dated Nov. 1, 2018.

* cited by examiner

EJECTION BLADE FOR A COMPACTION CHAMBER OF A WASTE COLLECTION VEHICLE

CROSS REFERENCE TO RELATED APPLICATION

This application is a national phase of International Patent Application No. PCT/AU2017/050708 filed Jul. 10, 2017, and which claims the priority filing benefit of Australian Patent Application No. 2016902771 filed Jul. 14, 2016, which are incorporated herein by reference in their entirety.

FIELD OF INVENTION

The present invention relates to an ejection blade (or often called a compaction blade). The present invention has particular but not exclusive application for a waste collection vehicle ejection blade. Reference will be made in the specification to use of the invention with respect to waste and waste collection vehicles. This use is by way of example only and the invention is not limited to this use.

BACKGROUND OF THE INVENTION

Waste from collected bins is emptied into a hopper of a waste collection vehicle. The hopper directs the waste into a compaction chamber of the vehicle. A hydraulically actuated ejection blade is positioned forward of the hopper during the loading process, allowing waste to enter through the hopper and into the compaction chamber. After the waste is received in the compaction chamber, the waste is moved towards the rear of the compaction chamber and compacted by the ejection blade. The ejection blade is shaped to fit closely to the profile of the compaction chamber. Compaction of the waste maximizes the amount of waste that can be collected by the waste collection vehicle When the compaction chamber is full and the waste is ready to be discharged, a rear cover is opened and the ejection blade is actuated, travelling the length of the compaction chamber to eject the load.

During the compaction process and the ejection process, waste such as wood and board products can be forced between the ejection blade and the floor of the compaction chamber resulting in a blade jam. Blade jams can lead to lengthy down times as the waste and the stuck waste needs to be manually and physically removed from the compaction chamber. Also when the blade jams, the waste collection vehicle is unable to collect any more waste thereby delaying the process.

OBJECT OF THE INVENTION

It is an object of the present invention to overcome or at least alleviate one or more of the above problems with waste collection vehicles and/or provide the consumer with a useful or commercial choice.

SUMMARY OF THE INVENTION

In one aspect the present invention broadly resides in an ejection blade for a compaction chamber with a hopper, the ejection blade including:

a blade body movable between a first position and a second position within the compaction chamber; and a lip attached to a lower portion of the blade body, the lip is movable to a raised position with respect to a floor of the compaction chamber when the blade body is moving to the first position and is in a lowered position with respect to the floor of the compaction chamber when the blade body is moving to the second position, wherein the first position is proximal to the hopper and the second position is distal to the hopper.

Preferably the lip is removably attached to the lower portion of the blade body.

Preferably the lip is movably attached to the lower portion of the blade body.

Preferably the lip is pivotably attached to the lower portion of the blade body. Preferably the lip is attached to the lower portion of the blade body by at least one hinge. Preferably the pivot axis of the lip is transverse to the direction of movement of the blade body between the first position and the second position.

Preferably the lip in the lowered position can pivot away from the direction of travel as the blade body moves towards the first position. Preferably the lip in the lowered position cannot pivot away from the direction of travel as the blade body moves towards the second position.

Preferably the lip has a brace portion. Preferably when the lip is in the lowered position the brace portion of the lip abuts a portion of the blade body and prevents the lip from pivoting away from the direction of travel as the ejection blade moves towards the second position.

Preferably, the ejection blade substantially conforms to an internal profile of the compaction chamber.

Preferably the ejection blade is adapted to compact waste or recyclable material against a cover located at an end of the compaction chamber proximal to the second position as the ejection blade moves from the first position towards the second position.

In another aspect the present invention broadly resides in a compaction chamber including:

a floor and opposed side walls defining an internal space of the compaction chamber;

a hopper; and an ejection blade movable within the internal space between a first position and a second position, the ejection blade including:

a blade body; and a lip attached to a lower portion of the blade body, the lip is movable to a raised position with respect to the floor of the compaction chamber when the blade body is moving to the first position and is in a lowered position with respect to the floor of the compaction chamber when the blade body is moving to the second position, wherein the first position is proximal to the hopper and the second position is distal to the hopper.

Preferably, the compaction member further includes a top wall. Preferably the top wall, the floor and the opposed side walls define the internal space of the compaction chamber. The compaction chamber may be formed from a tubular member, with a lower portion of the tubular member defining the floor, side portions of the tubular member defining the opposed side walls and an upper portion of the tubular member defining the top wall. For example, the tubular member can be a cylindrical tube.

Preferably, the compaction chamber has a discharge outlet at an end of the compaction chamber proximal to the second position. Preferably the compaction chamber further includes a cover. Preferably the cover is movable between a closed position in which the cover closes the discharge outlet and an open position in which the discharge outlet is accessible from outside of the compaction chamber.

Preferably the compaction chamber has an end wall proximal to the first position.

Preferably a movement means is operatively located at least partially between the ejection blade and the end wall. Preferably the movement means is adapted to move the ejection blade between the first position and the second position. Preferably the movement means is selectively movable. Preferably the movement means is or includes a hydraulic ram.

Preferably the hopper is located on an upper portion of the compaction chamber. More preferably the hopper is located on the top wall. Preferably the hopper provides access to the internal space of the compaction chamber. Preferably the hopper is adapted to receive waste or recyclable material and direct the waste or recycled material into the internal space of the compaction chamber.

Preferably, when the cover of the compaction chamber is in the closed position, the ejection blade is adapted to compact waste or recyclable material against the cover of the compaction chamber as the ejection blade moves towards the second position. Preferably, when the cover is in the open position, the ejection blade is adapted to eject at least a portion of the waste or recyclable material from the compaction chamber as the ejection blade moves from the first position towards the second position.

In a further aspect the present invention broadly resides in a waste collection vehicle, the waste collection vehicle including:

a compaction chamber, as described in this specification, including:

a floor and opposed side walls defining an internal space of the compaction chamber;

a hopper; and an ejection blade, as described in this specification, movable within the internal space between a first position and a second position, the ejection blade including:

a blade body; and a lip attached to a lower portion of the blade body, the lip is movable to a raised position with respect to the floor of the compaction chamber when the blade body is moving to the first position and is in a lowered position with respect to the floor of the compaction chamber when the blade body is moving to the second position, wherein the first position is proximal to the hopper and the second position is distal to the hopper.

Preferably, the waste collection vehicle further includes a loading fork to load waste or recyclable material into the compaction chamber. Preferably the waste collection vehicle is a front load waste collection vehicle. Preferably the front load waste collection vehicle loads waste or recyclable material from a front portion of the vehicle into the compaction chamber. For example, the loading fork can move a bin holding waste or recyclable material from a front portion of the vehicle to above the compaction chamber, the bin is then rotated and the waste or recycled material falls out of the bin and enters the compaction chamber via a hopper.

In a further aspect the present invention broadly resides in a method of compacting waste or recyclable material using an ejection blade, compaction chamber, or a waste collection vehicle as described above, the method including the step of:

moving the ejection blade between a first position and a second position, the ejection blade compacting the waste or recyclable material as the blade moves to the second position, wherein the lip is movable to a raised position with respect to the floor of the compaction chamber when the blade body is moving to the first position and is in a lowered position with respect to the floor of the compaction chamber when the blade body is moving to the second position, and wherein the first position is proximal to the hopper and the second position is distal to the hopper.

The features described with respect to one aspect also apply where applicable to all other aspects of the invention. Furthermore, different combinations of described features are herein described and claimed even when not expressly stated.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENT

Figure 1:
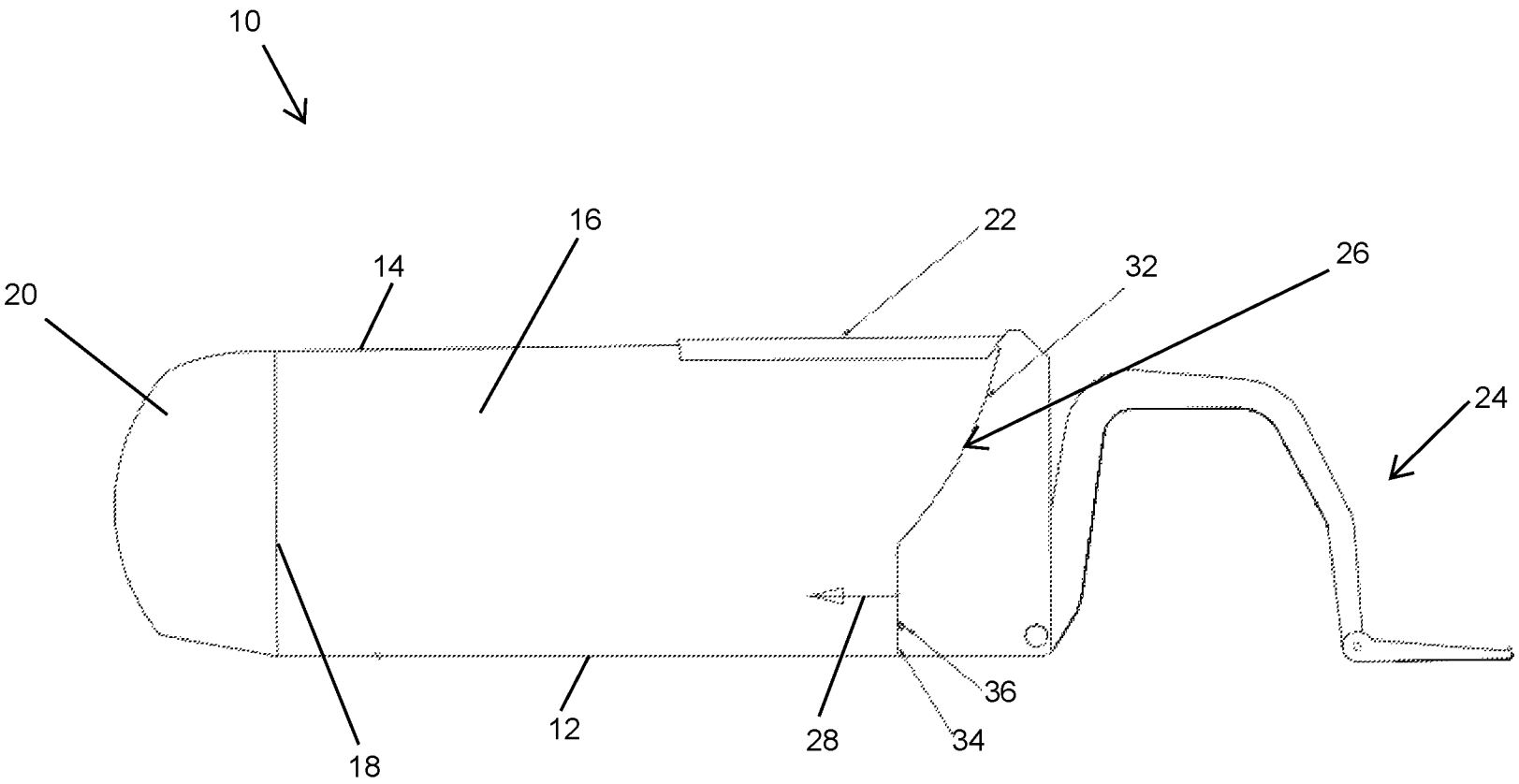
FIG. 1 is a schematic side view of a compaction chamber according to an embodiment of the present invention.
Figure 2:
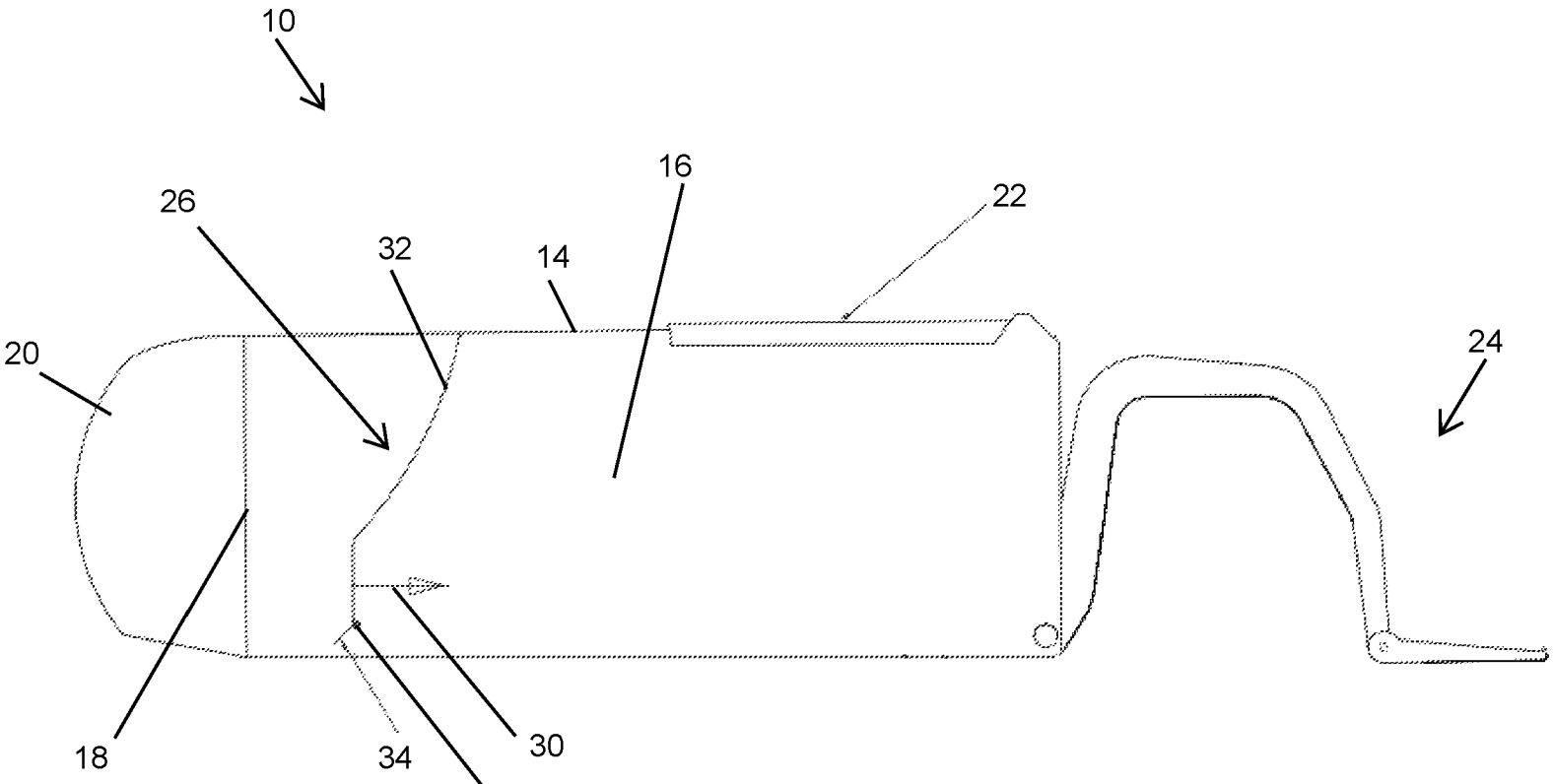
FIG. 2 is a schematic side view of the compaction chamber of FIG. 1.

With reference to FIGS. 1 and 2, there is shown a schematic view of a compaction chamber 10 according to an embodiment of the present invention. The compaction chamber 10 is part of a waste collection vehicle (not shown). The compaction chamber 10 has a floor 12 and a roof portion 14. Side walls 16 (only one shown) extend between the top wall 14 and the floor 12.

The compaction chamber 10 also has a discharge outlet 18 at one end thereof and an end wall 20 at an opposed end. A cover 20 covers the discharge outlet 18. The cover 20 is movable between a closed position (as shown) in which the cover 20 covers the discharge outlet 18 and an open position (not shown) in which the discharge outlet 18 is accessible from outside of the compaction chamber 10.

A hopper 22 is located on an upper portion of the compaction chamber 10. The hopper 22 provides access to the internal space of the compaction chamber 10. The compaction chamber 10 has loading forks 24 at a forward portion of the compaction chamber 10. The loading forks 24 are used to lift a waste container (not shown) containing waste or recyclable material over the hopper 22 and flip the waste container upside down to empty the waste or recyclable material into the hopper 22.

The compaction chamber 10 has an ejection blade 26. The ejection blade 26 is movable between a first position (as shown in FIG. 1) and a second position (as shown in FIG. 2). The compaction chamber has a movement means in the form of a hydraulic ram (not shown) which selectively moves the ejection blade 26 between the first and second positions. When the ejection blade 26 is in the first position (as shown in FIG. 1), waste or recyclable material can be dumped into the compaction chamber 10. After the waste or recyclable material is in the compaction chamber, the ejection blade 26 moves from the first position towards the second position (as shown in FIG. 2) to move and/or compact the waste or recyclable material towards the discharge outlet 18 and cover 20, arrow 28 (in FIG. 1) shows the direction of movement of the ejection blade 26 relative to the compaction chamber 10. The ejection blade 26 may also be referred to as a compaction blade.

After the ejection blade 26 moves back to the first position (as shown in FIG. 1), more waste or recyclable material can be dumped into the compaction chamber 10, arrow 30 (in FIG. 2) shows the direction of movement of the ejection blade 26 relative to the compaction chamber 10.

After the mobile compaction vehicle (not shown) has arrived at a waste or recycled material depot, the cover 20 is moved to the open position (not shown) and the ejection blade 26 moves from the first position (as shown in FIG. 1), towards the second position (as shown in FIG. 2), ejecting at least a portion of the waste or recyclable material in the compaction chamber 10.

The ejection blade 26 has an ejection blade body 32 and a lip 34. The lip 34 is rotatably attached to the ejection blade body 32 by a hinge 36. The lip 34 is prevented from rotating away from the direction of movement 28 (as seen in FIG. 1) of the ejection blade 26 as the ejection blade 26 moves from the first position (as seen in FIG. 1) towards the second position (as seen in FIG. 2). The lip 34 can rotate away from the direction of movement 30 (as seen in FIG. 2) as the ejection blade 26 moves from the second position (as shown in FIG. 2) towards the first position (as seen in FIG. 1). This ensures that as the ejection blade 26 moves from the first position (as seen in FIG. 1) towards the second position (as seen in FIG. 2), the lip 34 can move and/or compact waste or recyclable material towards the cover 20. This also ensures that as the ejection blade 26 moves from the second position (as seen in FIG. 2) towards the first position (as seen in FIG. 1), the lip 34 can rotate away from the direction of movement 30 (as seen in FIG. 2) to release any waste or recyclable material that may have become stuck between the lip 34 and the floor 12 of the compaction chamber 10.

Figure 3:
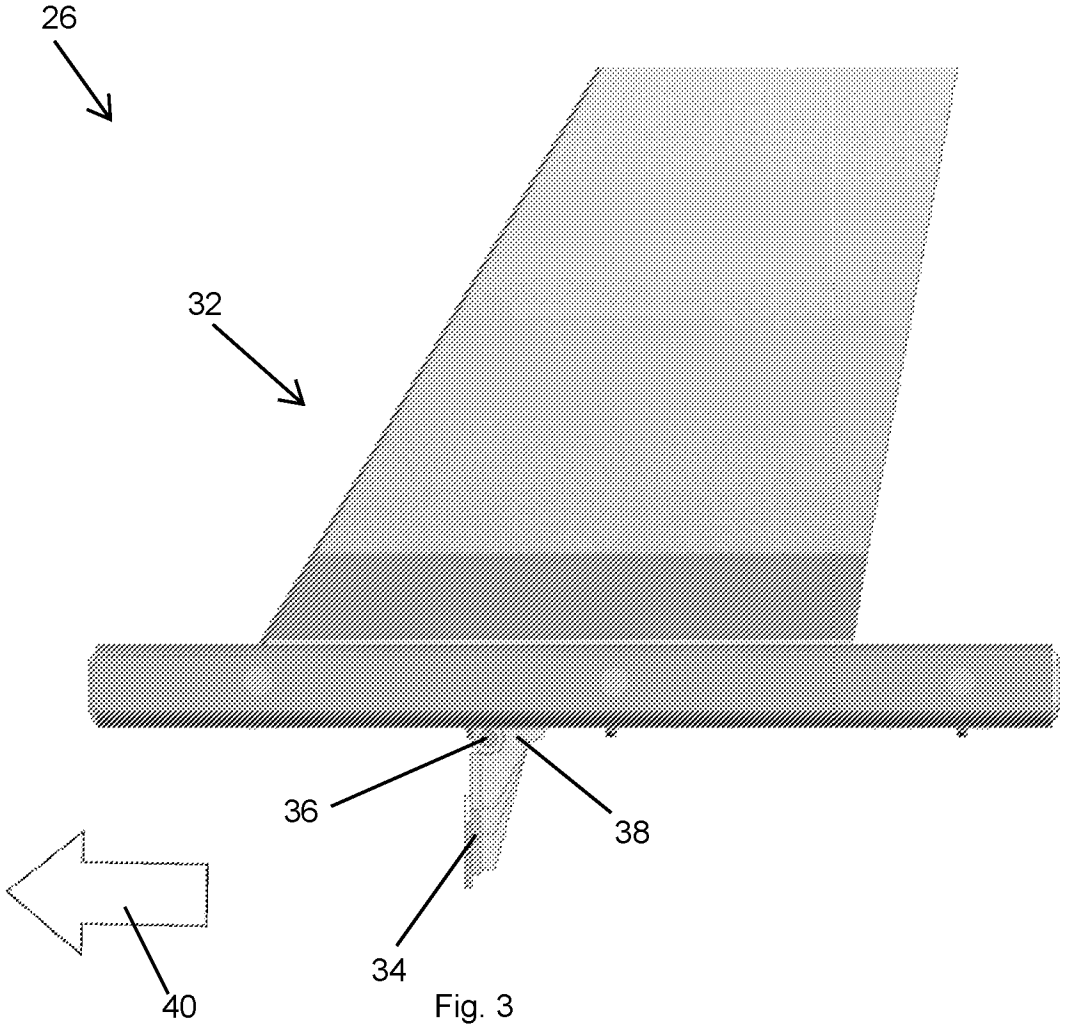
FIG. 3 is a detailed view of an ejection blade according to an embodiment of the present invention.
Figure 4:
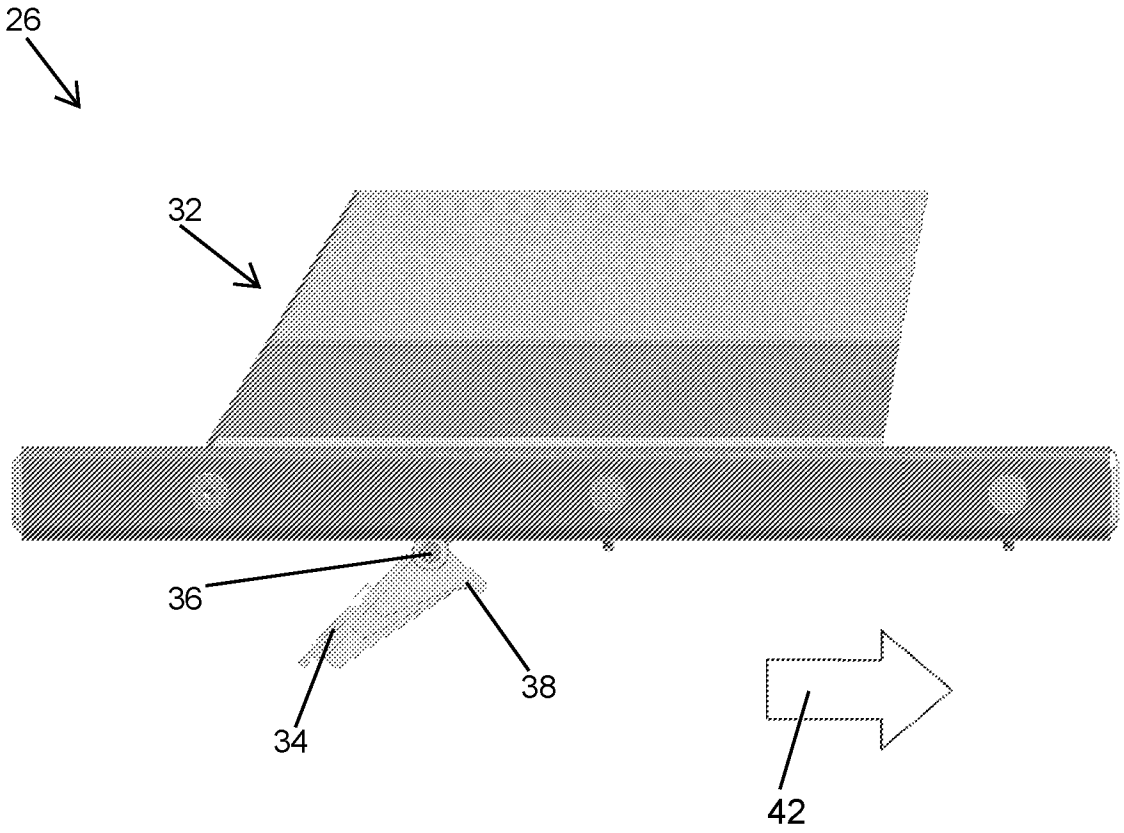
FIG. 4 is a detailed view of the ejection blade of FIG. 3.

With reference to FIGS. 3 and 4, there is shown detailed views of an ejection blade 26 according to an embodiment of the present invention. The ejection blade 26 has an ejection blade body 32 and a lip 34. The lip 34 is rotatably attached to the ejection blade body 32 by a hinge 36. The lip 34 includes a brace portion 38. When the lip 34 is in a lower position (as seen in FIG. 3), the brace portion 38 abuts a portion of the blade body 32.

When the ejection blade 26 moves in a first direction (as seen in FIG. 3), the brace portion 38 abutting a portion of the blade body 32 prevents the lip 34 from rotating from the lower position away from the direction of movement 40 (as seen in FIG. 3). When the ejection blade 26 is moving in a second direction (as seen in FIG. 4), the lip 34 is able to rotate from the lower position away from the direction of movement 42 (as seen in FIG. 4).

Advantages

An advantage of the preferred embodiment of the ejection blade includes an efficient compaction process where there is less downtime due to blade jams compared to conventional ejection blades.

Variations

While the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. An ejection blade for a compaction chamber with a hopper, the ejection blade including:

a blade body movable between a first position and a second position within the compaction chamber; and a lip pivotably attached to a lower portion of the blade body, the lip is movable to a raised position with respect to a floor of the compaction chamber, away from the direction of movement of the blade body, when the blade body is moving to the first position and is in a lowered position with respect to the floor of the compaction chamber when the blade body is moving to the second position, wherein the first position is proximal to the hopper and the second position is distal to the hopper, wherein the blade body is larger than the lip, and wherein the lip is prevented from moving away from the direction of travel in the lowered position as the blade body moves towards the second position.

2. An ejection blade as claimed in claim 1, wherein the lip is removably attached to the lower portion of the blade body.

3. An ejection blade as claimed in claim 1, wherein the lip is pivotable about a pivot axis which is transverse to the direction of movement of the blade body between the first position and the second position.

4. An ejection blade as claimed in claim 1, wherein the lip has a brace portion that abuts a portion of the blade body and prevents the lip from pivoting away from the direction of travel as the ejection blade moves towards the second position.

5. A waste collection vehicle including the ejection blade as claimed in claim 1.

6. A waste collection vehicle as claimed in claim 5 further including a loading fork to load waste or recyclable material into the compaction chamber.

7. A waste collection vehicle as claimed in claim 5 wherein the waste collection vehicle is a front load waste collection vehicle which loads waste or recyclable material from a front portion of the vehicle into the compaction chamber.

8. The ejection blade for a compaction chamber as claimed in claim 1, wherein a height of the lip in the lowered position is less than 25% of a height of the blade body.

9. A compaction chamber including:

a floor and opposed side walls defining an internal space of the compaction chamber;

a hopper; and an ejection blade movable within the internal space between a first position and a second position, the ejection blade including:

a blade body; and a lip pivotably attached to a lower portion of the blade body, the lip is movable to a raised position with respect to the floor of the compaction chamber, away from the direction of movement of the blade body, when the blade body is moving to the first position and is in a lowered position with respect to the floor of the compaction chamber when the blade body is moving to the second position, wherein the first position is proximal to the hopper and the second position is distal to the hopper, wherein the blade body is larger than the lip, and wherein the lip is prevented from moving away from the direction of travel in the lowered position as the blade body moves towards the second position.

10. A compaction chamber as claimed in claim 9, wherein the ejection blade substantially conforms to an internal profile of the compaction chamber.

11. A compaction chamber as claimed in claim 9, further including a top wall, the top wall, the floor and the opposed side walls defining the internal space of the compaction chamber.

12. A compaction chamber as claimed in claim 9, further including a discharge outlet at an end of the compaction chamber proximal to the second position, and a cover movable between a closed position in which the cover closes the discharge outlet and an open position in which the discharge outlet is accessible from outside of the compaction chamber.

13. A compaction chamber as claimed in claim 12, wherein when the cover of the compaction chamber is in the closed position, the ejection blade is adapted to compact waste or recyclable material against the cover of the compaction chamber as the ejection blade moves towards the second position.

14. A compaction chamber as claimed in claim 12, wherein when the cover is in the open position, the ejection blade is adapted to eject at least a portion of the waste or recyclable material from the compaction chamber as the ejection blade moves from the first position towards the second position.

15. A compaction chamber as claimed in claim 9, further including an end wall proximal to the first position, and a movement means operatively located at least partially between the ejection blade and the end wall, the movement means adapted to move the ejection blade between the first position and the second position.

16. A compaction chamber as claimed in claim 9, wherein the hopper is located on an upper portion of the compaction chamber, the hopper adapted to receive waste or recyclable material and direct the waste or recycled material into the internal space of the compaction chamber.

17. A waste collection vehicle including a compaction chamber as claimed in claim 9.

18. A compaction chamber as claimed in claim 15, wherein the movement means is a hydraulic ram.

19. A method of compacting waste or recyclable material using the ejection blade as claimed in claim 1, the method including the step of:

moving the ejection blade between the first position and the second position, the ejection blade compacting the waste or recyclable material as the blade moves to the second position, wherein the lip is movable to the raised position with respect to the floor of the compaction chamber when the blade body is moving to the first position and is in the lowered position with respect to the floor of the compaction chamber when the blade body is moving to the second position, and wherein the first position is proximal to the hopper and the second position is distal to the hopper.

20. A method of compacting waste or recyclable material using the compaction chamber as claimed in claim 9, the method including the step of:

moving the ejection blade between the first position and the second position, the ejection blade compacting the waste or recyclable material as the blade moves to the second position, wherein the lip is movable to the raised position with respect to the floor of the compaction chamber when the blade body is moving to the first position and is in the lowered position with respect to the floor of the compaction chamber when the blade body is moving to the second position, and wherein the first position is proximal to the hopper and the second position is distal to the hopper.

* * * * *